United States Patent [19]

Schulten

[11] Patent Number: 4,890,355

[45] Date of Patent: Jan. 2, 1990

[54] RELEASABLY MOUNTABLE HAND GRIP FOR HANDLES

[76] Inventor: Elizabeth W. Schulten, 415 Sorrento Dr., St. Louis, Mo. 63021

[21] Appl. No.: 262,832

[22] Filed: Oct. 26, 1988

[51] Int. Cl.[4] ..... A45F 5/10

[52] U.S. Cl. ..... 16/111 R; 16/110 R; 16/114 R; 16/114 B; 16/DIG. 12; 294/171; 383/13; 190/116

[58] Field of Search ..... 16/111 R, 114 R, 124, 16/125, DIG. 19, DIG. 13, DIG. 28, 110 R, 114 B, DIG. 12; 74/551.9; 294/171; 190/115, 116, 117; 383/13, 15

[56] References Cited

U.S. PATENT DOCUMENTS

| | | | |
|---|---|---|---|
| 3,072,955 | 1/1963 | Mitchell | 16/114 R |
| 3,083,366 | 3/1963 | Franges | 294/171 |
| 3,800,361 | 4/1974 | Stauffer | 294/171 |

FOREIGN PATENT DOCUMENTS

| | | | |
|---|---|---|---|
| 3138782 | 4/1983 | Fed. Rep. of Germany | 190/115 |
| 8101420 | 10/1982 | Netherlands | 16/111 R |
| 2132079 | 7/1984 | United Kingdom | 294/171 |
| 2153213 | 8/1985 | United Kingdom | 294/171 |

*Primary Examiner*—Nicholas P. Godici
*Assistant Examiner*—Edward Brown
*Attorney, Agent, or Firm*—Polster, Polster and Lucchesi

[57] ABSTRACT

A releasably mountable hand grip adapted to be mounted to a handle(s) associated with a plastic bag, totebag, collapsible luggage, briefcase and the like is disclosed. The hand grip includes an elongated tubular body having an inner and outer wall and opposite open ends. Opposed curvilinear sections are formed by a longitudinal opening extending along the length of the body, so as to enable the body to readily receive the handle or handle straps through the longitudinal opening. Interior gripping elements are provided on the inner wall of the body for gripping an associated handle, while exterior gripping elements are provided on the outer wall of the body to enable a user to comfortably grip the elongated tubular body when mounted on an associated handle. In certain instances, the opposed curvilinear sections may be constructed to form flexible wing sections to expand over an associated handle wider than the width of the longitudinal opening.

3 Claims, 2 Drawing Sheets

RELEASABLY MOUNTABLE HAND GRIP FOR HANDLES

Background of the Invention

A releasably mountable hand grip is adapted to be mounted to a handle(s) associated with a plastic bag, tote bag, collapsible luggage, briefcase and the like, to provide a comfortable hand grip enabling a user to comfortably grip and carry same.

As is well known, briefcases, luggage and other portable carriers are provided with a handle to facilitate carrying of such units. In some cases, the handle is rigidly supported by the unit itself; in other instances, the handle is pivotally mounted to the top of such units such that it lies across the top of the units when not in use, with the handle being pivotally mounted to an upright position for lifting the unit during use.

In many instances, whether fixed or pivotally mounted handles are used, the handles do not always provide a comfortable hand grip to facilitate carrying of the units. This is due, in part, to cost and design considerations; however, these factors are of little concern to users who must uncomfortably tote or lug heavy brief cases, luggage, and the like over long distances, such as in airplane terminals. If handles are uncomfortable over short distances, the uncomfortableness will be magnified where long distances are involved.

Typically, handles for such units are more uncomfortable where less expensive units are involved, such as thin straps used in collapsible cloth or material luggage units, and in other such inexpensive units. For example, plastic bags, tote bags and collapsible luggage typically have a pair of thin handle straps for gripping thereof by a user. Anyone who has ever toted a plastic bag so constructed at a convention, or carried a tote bag or collapsible luggage with thin straps through an airport terminal, has felt the strain of carrying such items, as the result of the thin handle straps forming creases in the hands of the user.

Summary of the Invention

Accordingly, among the several objects and advantages of the present invention may be noted:

the provision of a new improved releasably mountable hand grip adapted to be mounted on a handle associated with a plastic bag, collapsible luggage, briefcase and the like;

the provision of the aforementioned hand grip which overcomes the aforementioned disadvantages of the prior art;

the provision of the aforementioned hand grip which can be releasably mounted to a variety of different types of associated handles, while affording the same comfortable hand grip in all instances;

the provision of the aforementioned hand grip which can be quickly and easily mounted relative to an associated handle, and which retains its position relative to such associated handle by interior gripping elements formed in an inner wall of the hand grip;

the provision of the aforementioned hand grip which further includes an improved exterior gripping construction to enable a user to comfortably grip same when mounted on an associated handle;

the provision of the aforementioned hand grip which is a one-piece molded unit that is simple and economical to manufacture, is light weight and yet has a strong and rigid construction; has a pleasing overall design appearance; is relatively easy to keep clean; and is otherwise well adapted for the purposes intended.

Briefly stated, the releasably mountable hand grip of the present invention is adapted to be mounted to a handle associated with a briefcase, luggage and the like. The hand grip includes an elongated tubular body having an inner and outer wall and opposite open ends. Opposed curvilinear sections are formed in the body by a longitudinal opening extending along the length of the body, enabling the body to readily receive one or more handle straps through the longitudinal opening. The body further includes interior gripping means provided on the inner wall of the body for gripping an associated handle, and exterior gripping means provided on the outer wall of the body enabling a user to comfortably grip the elongated tubular body when mounted on an associated handle.

The interior gripping means includes a longitudinally extending series of internal projections extending from the inner wall of the body for engaging and gripping an associated handle. The longitudinal series of internal projections are positioned on an opposite side of the inner wall from the longitudinal opening.

The exterior gripping means includes a hand grip which conforms to the shape of a user's hand to facilitate gripping thereof. Specifically, the hand grip includes a series of alternating curvilinear recesses and ridges conforming to the fingers and spaces between the fingers of a user's hand. The exterior grip is provided on an opposite side of the body from the longitudinal opening.

Other and further objects and advantages will become apparent from the description that is to follow.

Brief Description of the Drawing

In the drawings.

Corresponding reference numerals will be used throughout the various figures in the drawing.

Description of the Preferred Embodiment

Figure 1:
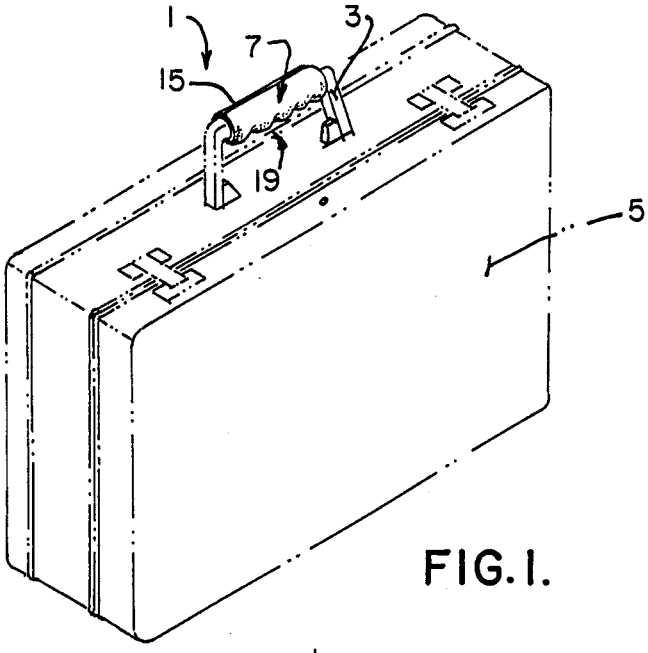
FIG. 1 is an isometric view of a briefcase, shown in phantom lines with a releasably mountable hand grip, shown in full lines, that is constructed in accordance with the teachings of the present invention.
Figure 5:
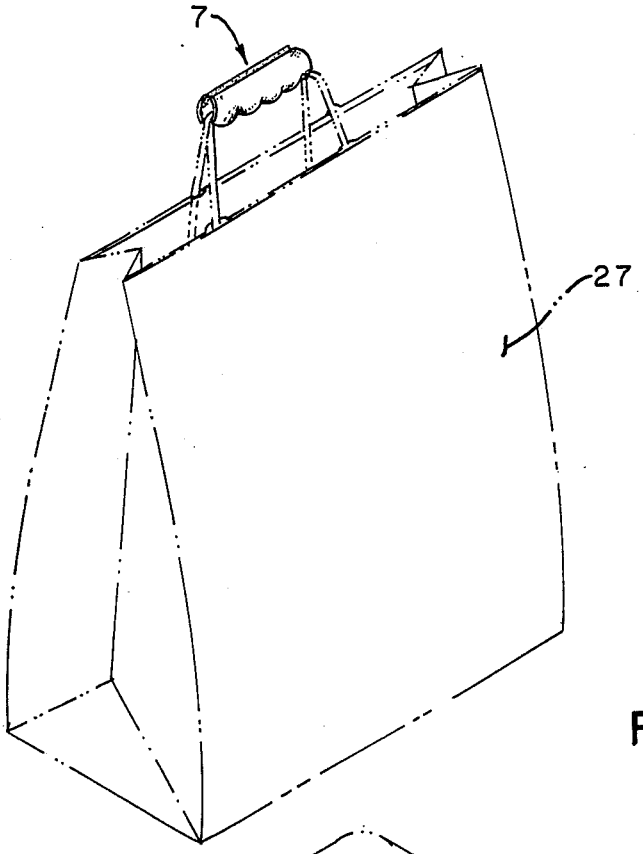
FIG. 5 is an isometric view of a plastic bag with handles, shown in phantom lines, with the releasably mountable hand grip shown in full lines.
Figure 6:
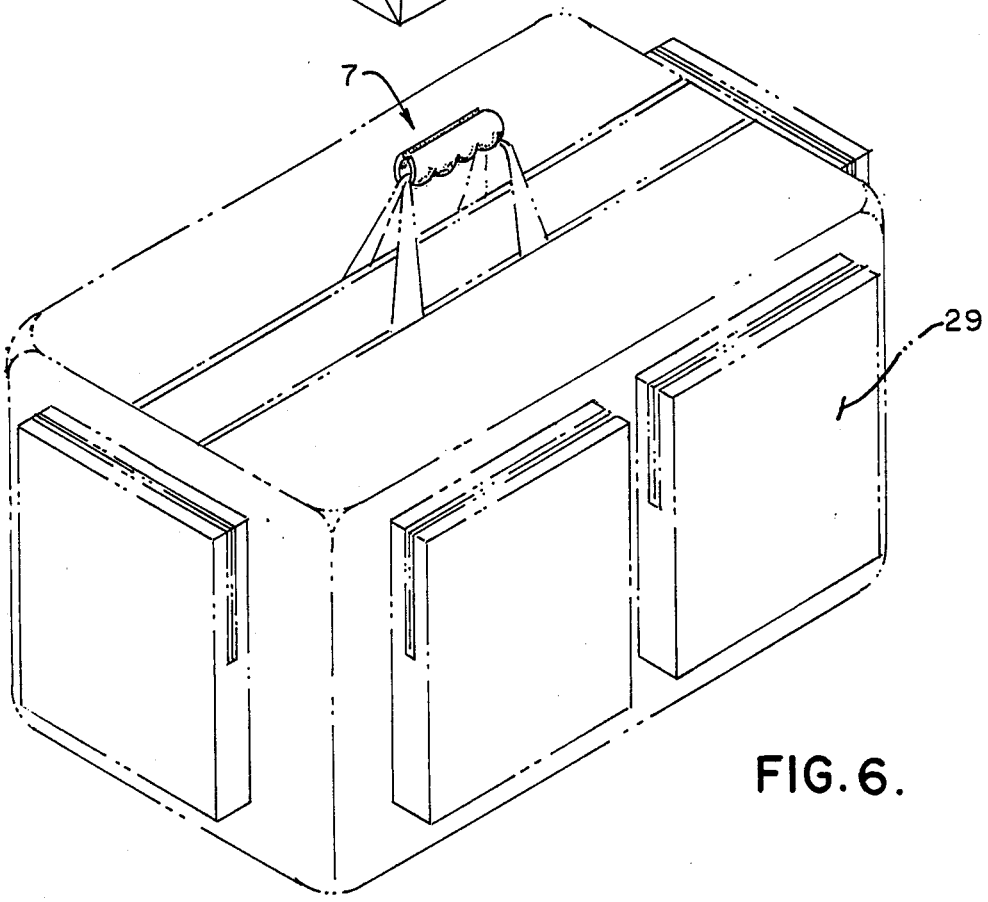
FIG. 6 an isometric view of a tote bag/collapsible luggage shown in phantom lines, with the releasably mounted hand grip shown in full lines.

The releasably mountable hand grip 1 is shown in FIG. 1 of the drawings as being mounted relative to an associated handle 3 of a briefcase 5. It will be appreciated that in lieu of a briefcase 5, luggage and other portable carriers having associated handles may have the releasably mountable hand grip 1 assembled to an associated handle thereof. FIG. 5 shows a plastic bag with handle straps engaged by the hand grip 1, while FIG. 6 shows a tote bag/collapsible luggage with handle straps engaged by the hand grip 1. As will be understood in the description that follows, the releasably mountable hand grip 1 is particularly useful where material has been removed from an associated handle 3 making it difficult to carry a briefcase, luggage and the like over long distances, although the releasably mountable hand grip 1 of the present invention may also be used with well constructed associated handle designs, to also improve the lifting and carrying of a portable unit such as briefcase, luggage and the like.

Figure 2:
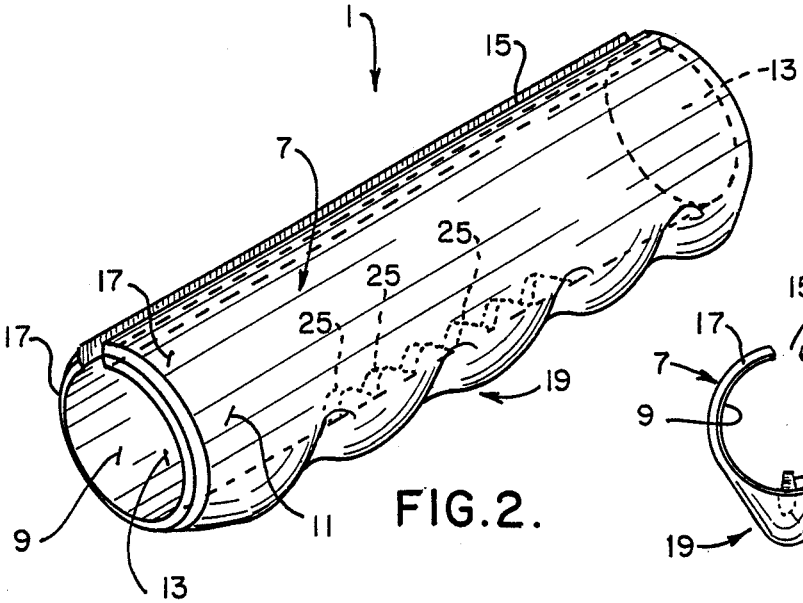
FIG. 2 is an enlarged isometric generally full-sized view of the releasable mountable hand grip of the present invention, and also illustrating in phantom lines some of the features thereof.
Figure 3:
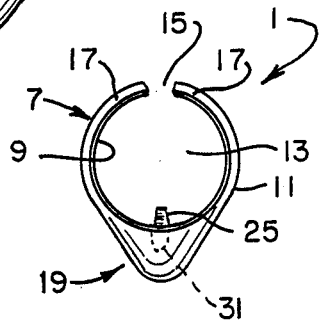
FIG. 3 is an end elevational and full-sized view of the releasable mountable hand grip of the present invention.
Figure 4:
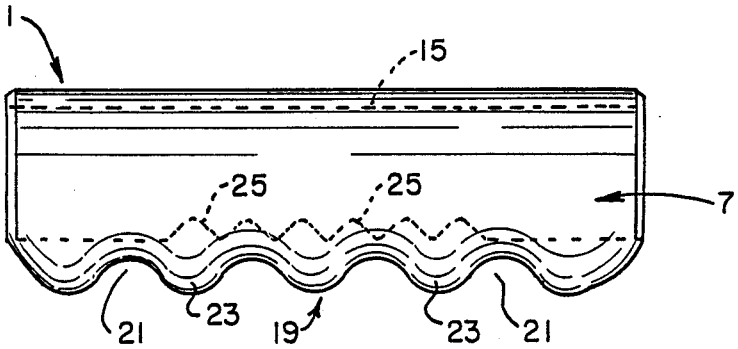
FIG. 4 is a side elevational and full-sized view of the releasable mountable hand grip of the present invention, also showing in phantom lines, some of the features of the invention.

The specific construction of the releasably mountable hand grip 1 as shown in FIGS. 2–4 embodiment, includes an elongated tubular body 7 having inner wall 9 and an outer wall 11, with opposite open ends 13, 13. Preferably, the elongated tubular body is formed or molded from plastic material, so as to provide in certain areas thereof flexible sections, while also affording rigidity and strength to the overall tubular body 7. A longitudinal opening 15 extends along the length of the tubular body 7 enabling the body 7 to provide opposed flexible wing sections 17, 17 on opposite sides of the longitudinal opening 15, enabling the body 7 to expand on both sides of the longitudinal opening 15 as the body 7 is positioned over an associated handle 3. For this purpose, it will be appreciated that the plastic material from which the tubular body 7 is formed has sufficient flexibility, and the dimension between the inner and outer walls 9, 11 of the tubular body is such that opposed flexible wing section 17, 17 on opposite sides of the longitudinally extending groove 15 will sufficiently flex to expand over an associated handle 3, and will thereafter collapse or return back to unexpanded tubular body shape 7 as shown in FIGS. 2–4 of the drawings.

When the releasably mountable hand grip 1 is positioned over an associated handle 3 in the manner just described, it may be necessary to rotate the tubular body 7 relative to the associated handle 3 to position the exterior gripping means 19 for gripping by a user. In the embodiment shown in the drawings, the longitudinally extending opening 15 is positioned in the tubular body 7 at a position generally opposite the exterior gripping means 19, such that the longitudinal opening 15 will extend above the horizontally extending portion of the associated handle 3 while the exterior gripping means 19 extends below, for gripping thereof by a user.

As best seen in FIGS. 2 and 4 of the drawings, the exterior gripping means 19 includes a hand grip which is conformed to the shape of a user's hand to facilitate gripping thereof. More specifically, the exterior gripping means or hand grip 19 includes a series of alternating curvilinear recesses 21 and ridges 23 conforming to the fingers and spaces, respectively, between the fingers of a user's hand. Thus, the fingers of a user's hand may comfortable rest within the curvilinear recesses 21 while the ridges 23 generally conform to and are positioned in the spaces between the fingers of a user's hand.

In addition to the external gripping means 19, a longitudinal series of internal projections 25 are provided on the inner wall 9 of the tubular body 7, generally on an opposite side of the inner wall 9 from the longitudinal opening 15. Although the longitudinal series of internal projections or serrations 25 may be generally aligned with the alternating curvilinear recesses and ridges 21, 23, depending on the design desired, the purpose of the projections 25 is to grip or engage at least a part of an associated handle 3, so as to hold or maintain the releasably mountable hand grip 1 positioned relative to an associated handle 3, with the exterior gripping means 19 readily positioned for engagement by a user's hand. As will be appreciated, the interior dimension of the tubular body 7 may be substantially greater than the associated handle 3, requiring the use of the longitudinal series of internal projections 25 to engage an associated handle 3 to maintain the releasably mountable hand grip 1 in the desired position. The longitudinal opening also contributes, in part, to possible enlargement of the interior dimension of a tubular body 7.

From the foregoing, it will be appreciated that the releasably mountable hand grip 1 may be readily mounted relative to an associated handle 3 by simply expanding the body 7 on opposite sides of the longitudinal opening 15, and causing the opposed flexible wing section 17, 17 to expand the tubular body 7 that is positioned over an associated handle 3. Interior gripping means in the form of the longitudinal series of internal projections 25 project from on the inner wall 9 of the tubular body 7 for engaging an associated handle 3, to prevent movement or unauthorized rotation of the hand grip 1, so as to position the exterior gripping means 19 in a position below the horizontally extending bar or section of an associated handle 3. The exterior gripping means 19 are provided on the outer wall 11 of the tubular body in the form of an alternating series of curvilinear recesses and ridges 21, 23 respectively, conforming to the fingers and spaces between the fingers of a user's hand.

As a result, the releasably mountable hand grip 1 provides an enlarged tubular body with the exterior gripping means or hand grip 19, affording a very comfortable hand grip for a user in lifting and carrying a briefcase, luggage and the like. The tubular body 7 is sufficiently rigid for carrying purposes, yet allows the opposed flexible wing section 17, 17 to expand in assembling and disassembling the releasably mountable hand grip 1 relative to an associated handle 3 of the briefcase 5 and the like.

Reference is now made to FIG. 5–6 of the drawings which show a plastic bag and tote bag/collapsible luggage having handle straps engaged by the hand grip 1 of the present invention. In these embodiments, the hand grip is constructed as shown in FIGS. 2–4, except that the opposed curvilinear sections are not flexible. Therefore, the thin, flexible handle straps of the plastic bag 27, shown in FIG. 5, or the totebag/collapsible luggage 29, shown in FIG. 6, are readily received within the longitudinal opening 15 of the elongated tubular body 7, without any necessity of expanding the opposed curvilinear sections 17, 17 thereof. In these embodiments, the internal gripping means 25 engage the thin, flexible handle straps, so as to prevent bag 27 or the tote bag/-collapsible luggage 29, from shifting from side-to-side. In all other respects the releasably mountable hand grip 1 in the FIGS. 5–6 embodiments function similar to the FIGS. 1–4 embodiment. For use with foam plastic coolers of the like having elongated rigid wire handles for gripping by the user, the internal gripping means 25, in lieu of the projections 25, may include an elongated slot or slots 31 (see FIG. 3) formed, for example, in the inner wall 9 of the elongated tubular body 7, allowing the elongated rigid wire handles of the foam coolers to fit or slip within the elongated slot or slots 31, for holding same relative thereto, for the purposes set forth above.

In view of the above, it will be seen that the several objects and features of this invention are achieved and other advantageous results obtained.

As various changes could be made in the above construction without departing from the scope of the invention, it is intended that all matter contained in the above description or shown in the accompanying drawings shall be interpreted as illustrative and not in a limiting sense.

I claim:

1. A hand grip for releasable attachment to a carrying unit, comprising:

an elongated tubular body having an inner wall, an outer wall, and a material thickness therebetween, said tubular body being open ended and having an axial opening extending through it, said body being oriented with respect to said carrying unit so as to define an upper portion and a lower portion, said body having a longitudinal opening in it which communicates with said axial opening for enabling said body to receive an associated part of said carrying unit through said longitudinal opening, said longitudinal opening being positioned along said upper portion;

exterior gripping means defined by the outer wall of said tubular body, said outer wall defining a hand gripping grip conformed to the shape of a user's hand to enable a user to grip said elongated tubular body comfortably when said tubular body is mounted on an associated part of said carrying unit, said exterior gripping means being positioned along the lower portion of said tubular body opposite said longitudinal opening; and a plurality of serrations arranged in a single row longitudinally or said inner wall and aligned opposite said longitudinal opening in said hand grip and adjacent said exterior gripping means, said serrations, longitudinal opening, and exterior gripping means aligned in a common plane said serrations adapted to engage at least a portion of said associated part of said carrier unit when said hand grip is attached to said carrier unit.

2. The hand grip of claim 1 wherein said associated part of said carrying unit extends axially outwardly on each end of said handle.

3. The hand grip of claim 2 wherein said handle is sufficiently flexible to enable it to expand over the associated part of said carrying unit when said associated part has dimensions greater than said longitudinal opening for capturing said associated part within said tubular body.

* * * * *